US006270873B1

(12) United States Patent
Darnett

(10) Patent No.: US 6,270,873 B1
(45) Date of Patent: Aug. 7, 2001

(54) ABSORBENT PAD

(75) Inventor: Rodney Darnett, Queensland (AU)

(73) Assignee: Sealed Air Corporation (US), Saddle Brook, NJ (US)

( * ) Notice: Subject to any disclaimer, the term of this patent is extended or adjusted under 35 U.S.C. 154(b) by 0 days.

(21) Appl. No.: 09/125,615

(22) PCT Filed: Feb. 19, 1997

(86) PCT No.: PCT/AU97/00086

§ 371 Date: Sep. 2, 1998

§ 102(e) Date: Sep. 2, 1998

(87) PCT Pub. No.: WO97/30909

PCT Pub. Date: Aug. 28, 1997

(30) Foreign Application Priority Data

Feb. 22, 1996 (AU) ..... PN8248
Mar. 27, 1996 (AU) ..... PN8949

(51) Int. Cl.[7] ..... B32B 1/06
(52) U.S. Cl. ..... 428/76
(58) Field of Search ..... 428/68, 72, 73, 428/74, 76; 62/259.3; 604/358; 607/114

(56) References Cited

U.S. PATENT DOCUMENTS

| | | | | |
|---|---|---|---|---|
| 3,156,402 | * | 11/1964 | DuPuis | 229/30 |
| 4,275,811 | | 6/1981 | Miller | 206/204 |
| 5,274,865 | * | 1/1994 | Takehashi | 5/644 |
| 5,789,076 | * | 8/1998 | Isohata | 428/315.9 |

FOREIGN PATENT DOCUMENTS

| | | |
|---|---|---|
| 42151/93 | 1/1994 | (AU) . |
| 11573/95 | 8/1995 | (AU) . |
| 0 353 334 A1 | 2/1990 | (EP) . |
| WO 90/3320 | 4/1990 | (WO) . |

* cited by examiner

*Primary Examiner*—Alexander S. Thomas
(74) *Attorney, Agent, or Firm*—Rupert B. Hurley, Jr.

(57) ABSTRACT

An absorbent pad has a top sheet and a bottom sheet, the sheets being joined to form at least one cell, an absorbent located within the cell, at least one sheet being formed of a liquid impermeable material containing microperforations. The top and/or bottom sheets may comprise multiple layers of different materials, e.g., plastics, non-woven fabrics, paper.

21 Claims, 19 Drawing Sheets

ABSORBENT PAD

FIELD OF THE INVENTION

This invention relates to an absorbent pad and particularly to an absorbent pad for use in the food industry as a biofluid absorbent, or a for a cooling pad.

BACKGROUND ART

Absorbent pads are well-known and widely used in the food industry. One type of absorbent pad is used as a biofluid absorber and is placed between fresh meat and the plastic meat tray. The pad functions to absorb biofluids exuding from the meat.

A second type of known pad is used as a cooling pad and is initially swelled with water, frozen and then placed with food or other produce which is to be kept cool.

Both types of pads have internal absorbents and typically use superabsorbent polymers (SAP). These polymers are also well-known and a typical polymer is a cross-linked sodium polyacrylate. In order to allow the internal absorbent to absorb fluid efficiently, the polymer is usually finely ground.

The internal superabsorbent polymer creates some difficulties which must be overcome if the pad is to be safe and commercially successful. Firstly, it is necessary to ensure that the polymer stays within the pad at all times, even when swollen into a gel-like state. Another problem with the superabsorbent polymers is that they are aggressive fluid absorbers and tend to desiccate the meat product by absorbing more than just the exuded biofluids.

To overcome the aggressive absorbing nature of the polymer, it is known to have absorbent pads formed with a bottom wall which is water permeable (and is typically a non-woven fabric), and a top wall formed from a totally liquid impermeable sheet.

A disadvantage with having a liquid impermeable top sheet is that biofluids run over the top sheet and fall away from the pad without the pad being able to absorb the biofluid through the bottom layer. This is particularly so if the meat product tray is stored or presented at an angle. Another disadvantage with the impervious top layer is that if the meat tray is level, biofluids can pool on the top layer and ruin the meat by promotion of bacterial growth.

Attempts have been made to provide a large slit or a number of slits in the top wall of the pad to overcome the above disadvantage. However the biofluids are still not efficiently absorbed and have a tendency to run off the top sheet, or to pool.

Another problem with cooling pads is that when the pads are swollen with water, the superabsorbent polymer turns into a gel and exerts considerable pressure on the wall of the pad and can extrude through the pad wall. This is particularly so if the top wall of the pad is formed with a large slit or slits.

OBJECT OF THE INVENTION

The present invention has been developed to provide an absorbent pad which can be used both as a biofluid absorber and also as a cooling pad and which can at least reduce the abovementioned disadvantages or provide the public with a useful or commercial choice.

In one form, the invention resides in an absorbent pad which has a top sheet and a bottom sheet, the sheets being joined to form at least one cell, a absorbent located within the cell, characterised in that at least one of the sheets is formed from a liquid impermeable material containing microperforations to allow fluid to pass through the microperforations and into the cell.

It is preferred that the top sheet is formed from the microperforated material. The bottom sheet may be formed from similar material, or different material such as a water-permeable non-woven sheet, a paper sheet, or a totally water impermeable sheet.

We find that the microperforations temper the aggressiveness of the superabsorbent polymer within the cell or cells. That is, the microperforations minimise the drawing effect which results in undesired desiccation of the meat product. The drawing effect appears to be minimised to an acceptable level by having a large number of extremely small perforations in the sheet of the absorbent pad which can then be placed under the meat product.

The microperforations also appear to reduce or prevent pooling of biofluids on top of the absorbent pad and if the microperforations are spread over the top sheet of the absorbent pad, biofluid absorption can occur over a larger surface area than might be the case if the pad was only slotted or slitted.

The microperforations are typically spread over the sheet in a substantially homogenous fashion. It is however envisaged that parts of the sheet may not include microperforations and these parts may include the joints between adjacent cells.

The microperforations may have various shapes and sizes and may be circular, elliptical (cigar-shaped), polygonal (including rectangular, triangular and diamond-shaped), irregular and the like. Depending on the process used to perforate the sheet, the formed perforations may have a flap or hinge portion adjacent the formed hole which still allows liquids to pass through the perforations.

The microperforations can be formed by hot pin perforating, cold pin perforating, open flame perforating, laser perforating, and by other suitable techniques. The different perforating processes may form different hole sizes and shapes.

A typical size of the microperforation can be between 10 to 200 microns. For instance, if the perforation is elliptical, it may have a size of approximately 20 microns×90 microns, but this can vary between 10 microns and 200 microns, possibly even more, the larger size being determined by the aggressiveness of the absorbing polymer or other type of absorbent.

The number of microperforations in the sheet may also vary as can be regularity or irregularity of the microperforations. There may be provided between 10 to 500 microperforations per square inch and we find a microperforation number of 330 per square inch to be suitable for our purposes. We find that the number of holes per square inch appears to affect only the absorbent rate of the product.

The size of the absorbent pad itself can also vary depending on its use. We find that a typical pad may be about 400 mm across and have an unlimited length with the consumer able to simply cut the pad lengthwise to suit. Each pad may have one or more cells, and we find that for a pad having a width of 400 mm, there may be provided 6 or so cells. Each cell can be of any shape or size and we find a suitable size to be between 40 mm to 100 mm across.

The sheet containing microperforations (which is typically the top sheet), can be formed from a plastic film. The plastic film can be a single film, a laminate film or other type of film. One type of useful film is a laminate formed from a polyester and a polyethylene. We find a suitable thickness to be a 12 micron polyester film laminated to a 30 micron polyethylene film. Other film thickness can be used if desired. We find that other types of plastics can be used such as nylon, other types of polyene film such as all types of polyethylenes and polypropylenes. We also find use for polyurethane and polyvinyl films. We find that the main property desired from the film is that it is able to be strong enough to resist wear and tear during use. We also find it desirable to choose a film which can accept printing inks such that the sheets of the pad, or at least one sheet of the pad, can be printed. We find it desirable from a consumer point of view that the films have a good opacity. If we form the pad by heat sealing the top sheet and the bottom sheet together, we prefer the films to be heat sealable.

If the absorbent pad contains a microperforated top sheet and a different type of bottom sheet, one type of preferred bottom sheet is a non-woven fabric. Many types of non-woven fabrics are known in the art, and a suitable fabric is a 40 g per square meter bi-component continuous filament which is pressure and temperature bonded. The filament can be made of a polyester core with a polyethylene sheath and this type of material is known. The filament may comprise a different type of sheath plastic such as polypropylene or a polypropylene polyethylene co-polymer. These filaments are desirable because a strong heat seal can be formed in the non-woven fabric. These non-woven fabrics have a good random distribution of the fibres to ensure that the pore size or holes in the fabric are small enough to prevent polymer from being shaken out of the pad, and also to prevent the swollen hydrated polymer from squeezing through the fabric.

It should be appreciated that there are many types of non-woven fabrics available in the marketplace which could fulfil our requirements.

If the top sheet is microperforated, we may desire to have the bottom sheet totally liquid impermeable and this type of sheet may be formed from any type of suitable water impermeable plastic film or other type of film which may be available from time to time.

In order to reduce the possibility of absorbent egress from the cells in the pad, a further barrier sheet can be provided below the microperforated sheet. The barrier sheet is preferably of the type that will allow fluid to pass or wick through the sheet but will act as a barrier for the absorbent. Various types of papers can be used as the barrier sheet.

In a further variation, the top sheet may comprises a preformed multi-layer sheet composite. For instance, the top sheet can comprise an outermost microperforated sheet, an intermediate barrier sheet and an innermost microperforated sheet to form a triple layer sheet composite. This multi-layer sheet can form the top sheet and/or the bottom sheet of the absorbent pad.

In order to strengthen the microperforated sheet, a further reinforcement sheet may be provided. Occasionally, it is found that the pressure inside the absorbent pad is such that it can place an undesirable amount of strain on the microperforated sheet. This sheet is weakened by having the microperforations in it, and there is a possibility that the microperforated sheet can tear or split. For instance, when the pad is used as an ice replacement pad, it is swollen with water and then frozen. The swelling and freezing creates considerable pressure within the pad. It is common to provide a flexible sheet having a number of absorbent cells within it. The flexible sheet can be swollen with water, frozen and then wrapped around the product which is to be kept cool. It is found that when the product is frozen, the microperforated sheet can approach its cold flex temperature which means that the film resists flexing and is susceptible to formation of cracks and tears.

For this reason, the absorbent pad can include the reinforcement sheet. The reinforcement sheet may be positioned behind the microperforated sheet. It is preferred that the reinforcement sheet does not appreciably prevent fluid from passing into the absorbent. Therefore, a preferred reinforcement sheet is a non-woven fabric, or a microperforated film.

The absorbent in the cell of the pad may comprise a single type of absorbent or mixture. Although many types of absorbents are known and used in absorbent pads, we find it desirable to use a superabsorbent polymer, as such polymers can absorb many times their weight in liquid, and although these polymers are aggressive absorbers, we have overcome or tempered this undesirable feature by using the microperforations.

A desired type of superabsorbent polymer include the family of sodium polyacrylates which are sodium salts of cross-linked polyacrylic acid/polyalcohol grafted co-polymers. These polymers are known and are also known for their use in absorbent pads. Other types of absorbents which we find useful are the sodium carboxy methyl cellulose and these can be cross-linked with a number of different types of aluminum compounds to improve their gel strength qualities. Of course, other types of absorbents can be used with our microperforated pad.

We find that the commercial superabsorbent polymers come in two distinct shapes. The most common types of shape is an irregular granular or gravel shape, while the other shape is a more rounded spherical configuration.

We also find that the commercial superabsorbent polymers have varying particle sizes and typical particle sizes are as follows 850 micron and above: 0–2%

850–600 microns: 24–32%

600–500 microns: 20–28%

500–300 microns: 32–40%

300–180 microns: 4–12%

180–90 microns: 0–4%

90–45 microns: 0–2%

45 microns and below: 0–0.1%

Different batches of polymer can have different size ranges and size extremes such as up to or even about 2000 microns, and it will be appreciated that we can adjust our microperforation shape and size to compliment that of the absorbent we use in the cells to minimise or at least reduce undesirable loss of absorbent through the cell wall.

The amount of absorbent we use can run of course vary depending upon the absorbent capacity and rate and depending upon how much liquid we wish to absorb. A typical superabsorbent polymer will absorb anywhere between 100 g to 500 g of tap water per gram of polymer.

We prefer that the polymer dosage in the cell is such that the polymer is able to fully hydrate and is not prevented from full hydration. For this reason, we prefer that not too much polymer is added in each cell. We find that when our pad is used as a cooling pad, consumers do not wish to believe that the cooling pad will absorb any other liquids from the surrounding area, and instead will only function as a cooling pad. For this reason, we like to ensure that the polymer can be fully hydrated before freezing if it is used as a cooling pad.

The pad itself can be formed in a number of different ways. One preferred way, and a way which has been used in other known pads, is to heat seal the top sheet and bottom sheet together. For this reason, we prefer that the top sheet and bottom sheet are formed from heat meltable materials, and these materials are known. Of course, we may also wish to simply glue the sheets together, or attach them by other means.

BRIEF DESCRIPTION OF THE FIGURES

Embodiments of the pad will be described with reference to the following drawings in which.

BEST MODE

Referring to the figures, there are shown two types of absorbent pads one particularly suitable for absorbing biofluids (the pad of FIGS. 1–3, 7–9) and one particularly suitable as a cooling or heating pad (the pad of FIGS. 4–6, 10–12). The pads differ in the size of the cells, and the type of bottom sheet; the top sheet of each pad being microperforated.

Figure 1A:
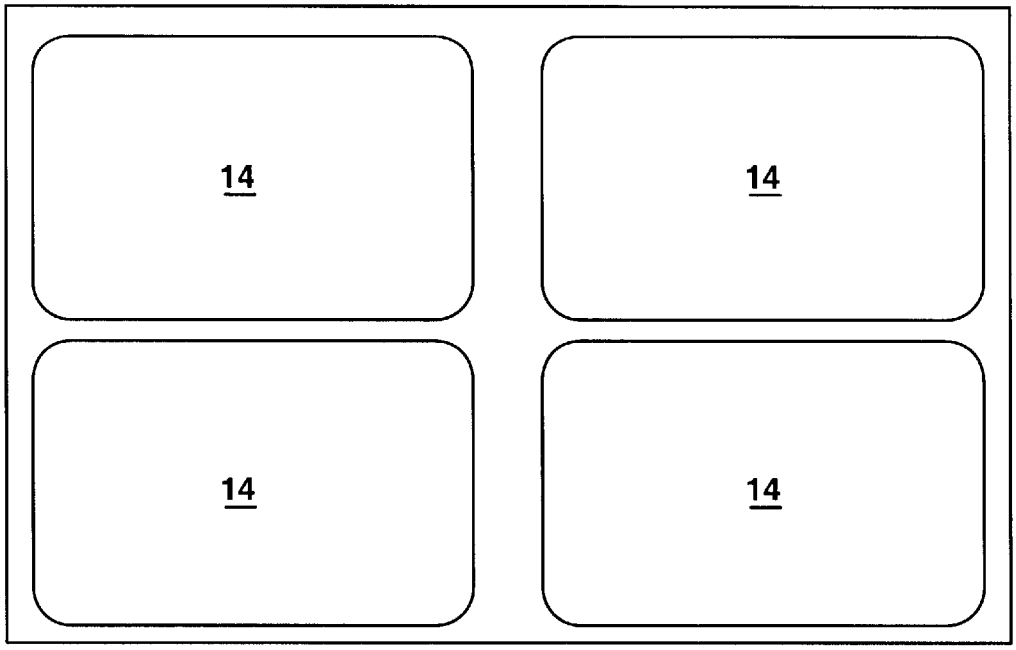
FIGS. 1A and 1B illustrate a fluid absorbing pad having a top sheet and a bottom sheet both being microperforated.
Figure 1B:
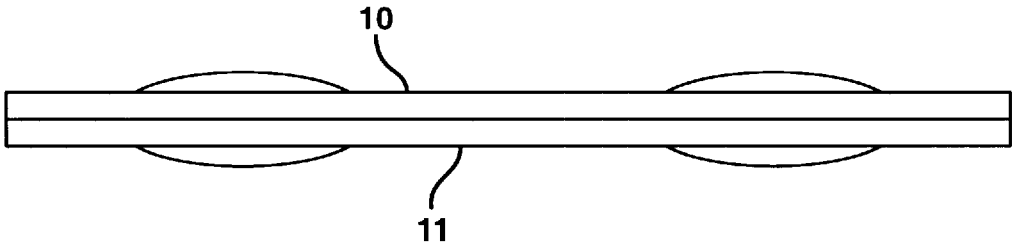
Figure 2A:
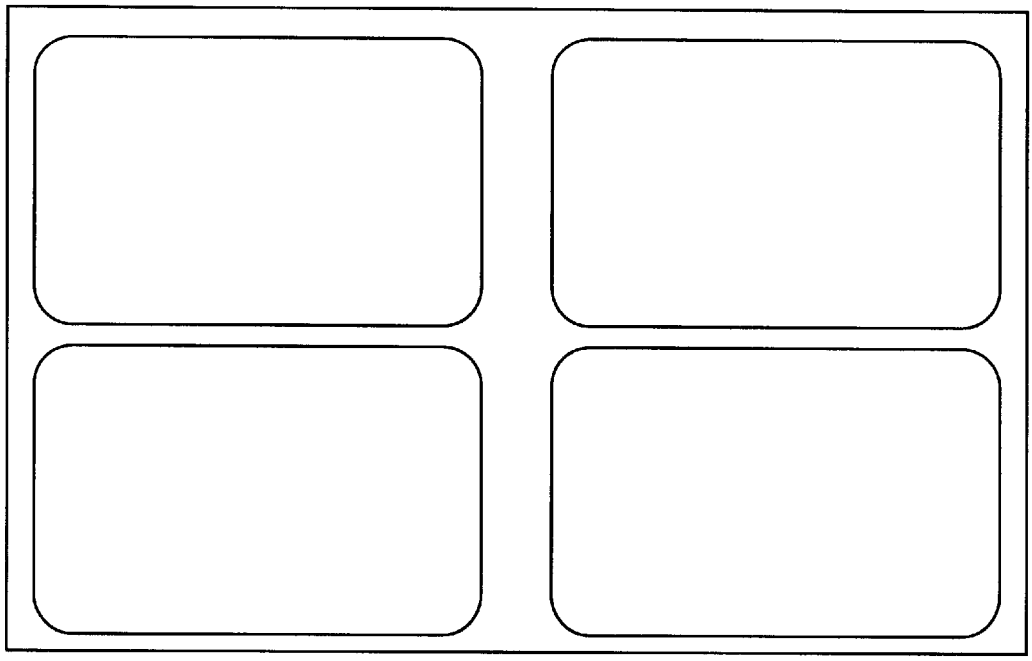
FIGS. 2A and 2B illustrate a fluid absorbing pad having a top microperforated sheet and a bottom non-woven fabric sheet.
Figure 2B:
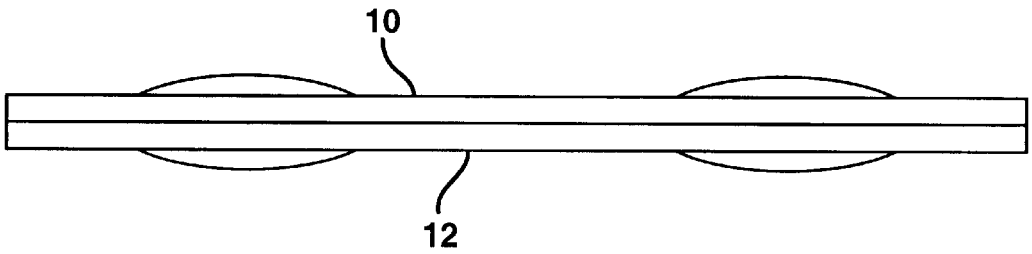
Figure 3A:
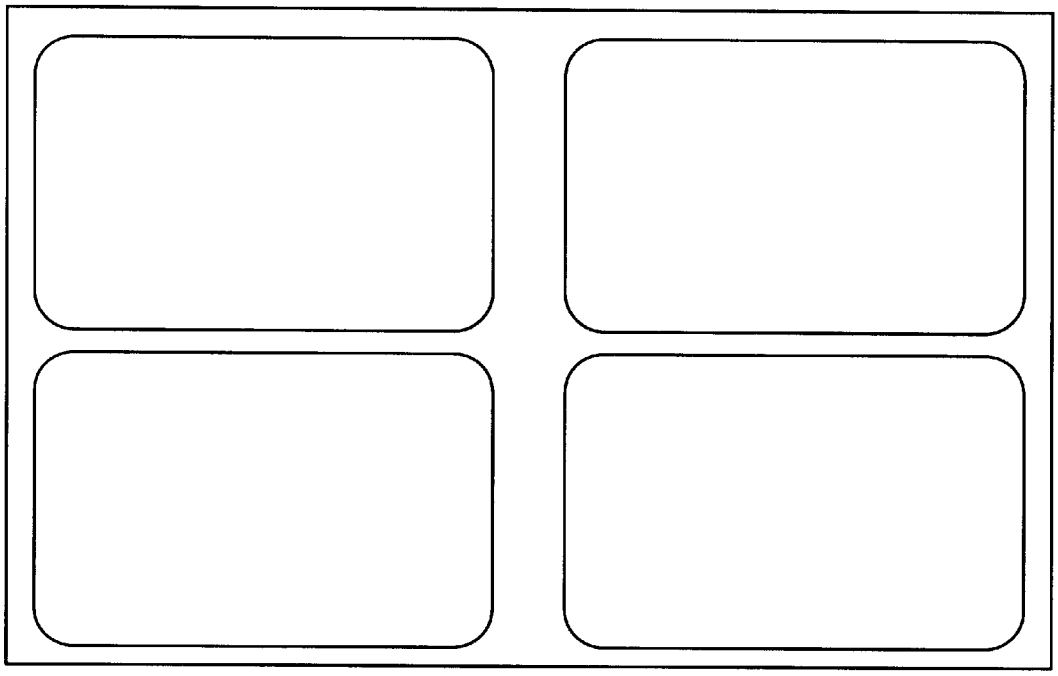
FIGS. 3A and 3B illustrate a fluid absorbing pad having a top microperforated sheet and a bottom paper sheet.
Figure 3B:
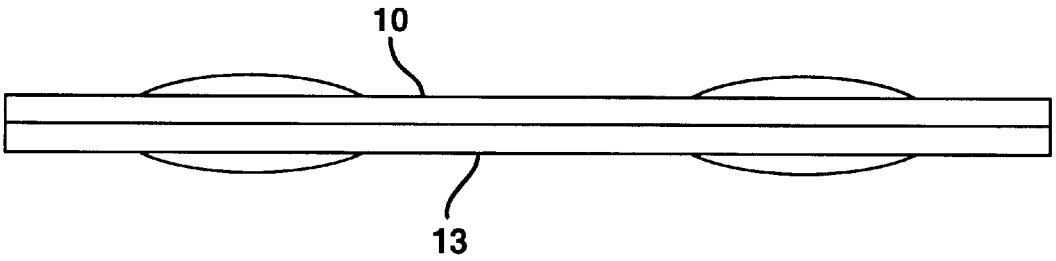

Referring initially to the pads of FIGS. 1–3, these pads can be used as a red meat or poultry pad and can be positioned between a meat product and the meat tray. These pads find particular use in meat trays which are found for sale in supermarkets, butchers and the like.

The absorbent pad can come in two main sizes and absorption capacities. One type of pad can have an external dimension of 113 mm×169 mm with an internal cell size of 50 mm×72.8 mm. In each cell is provided 0.48 g of Favor Pac 100th superabsorbent powder which is a sodium polyacrylate and is available commercially. The pad has an overall absorption capacity of about 108 g of chicken biofluids. The other main size of the absorbing pad is used particularly in the poultry market and this pad is used particularly in the poultry market and this pad has an external measurement of 141 mm×169 mm with the internal cell being 64 mm×72.8 mm. 0.75 g of the same superabsorbent polymer is placed in each cell giving the pad an absorption capacity of 120 g of biofluids.

The absorbing pads of FIGS. 1–3 have a top sheet 10 constructed from a plastic laminate film which is a 12 micron polyester film adhered to a 30 micron polyethylene film. The film is microperforated to a perforation rate of 330 perforations per square inch. The perforations are evenly spread through the top sheet, and each perforation is cigar-shaped having a perforation size of 20 micron across×90 microns along.

Each pad has a number of cells or pouches 14 in which the absorption is placed. The cells are totally sealed off around their edges by heat sealing or by other means.

The bottom sheet 11 of the absorption pad of FIG. 1 is identical to the top sheet such that this particular pad is microperforated on both sides. In FIG. 2, the bottom sheet 12 is a water permeable non-woven fabric, and in FIG. 3, the bottom sheet 13 is a heat fusible paper. Other variations are also envisaged.

The pads of FIGS. 1–3, may include as an option one or two light-weight heat fusible paper sheets. The function of these paper sheets is to act as a molecular sieve to stop any polymer migration. The paper sheets have a weight of 16.5 g per square meter and are a blend of cellulose fibres and thermo plastic fibres and the sheet is itself commercially available.

In FIG. 2, the bottom sheet 12 is a white polyester/viscose fibre blend which is resin bonded and has a low density polyethylene scatter coating on the inside of the product. The fabric has a typical weight of 65 g per square meter with a 45 g per square meter fibre/binder blend. With the low density polyethylene scatter coating on the inside of the product, we find that the fabric has an adequate thermal bond with other substrates. The non-woven fabric wets out instantaneously and draws liquids into the fabric once contact has been made and to transport the liquids to the superabsorbent polymer.

In FIG. 3, the bottom sheet 13 is a heavier weight heat fusible paper which is a blend of cellulosic and thermo plastic fibre and can have a weight of between 5–100 g per square meter. Typically, the paper has 22% thermo plastic fibre and 78% cellulose fibre and is resin bonded to have a good wet strength. The paper has a good wetting and wicking action to assist in drawing fluids to the superabsorbent polymer.

Figure 4A:
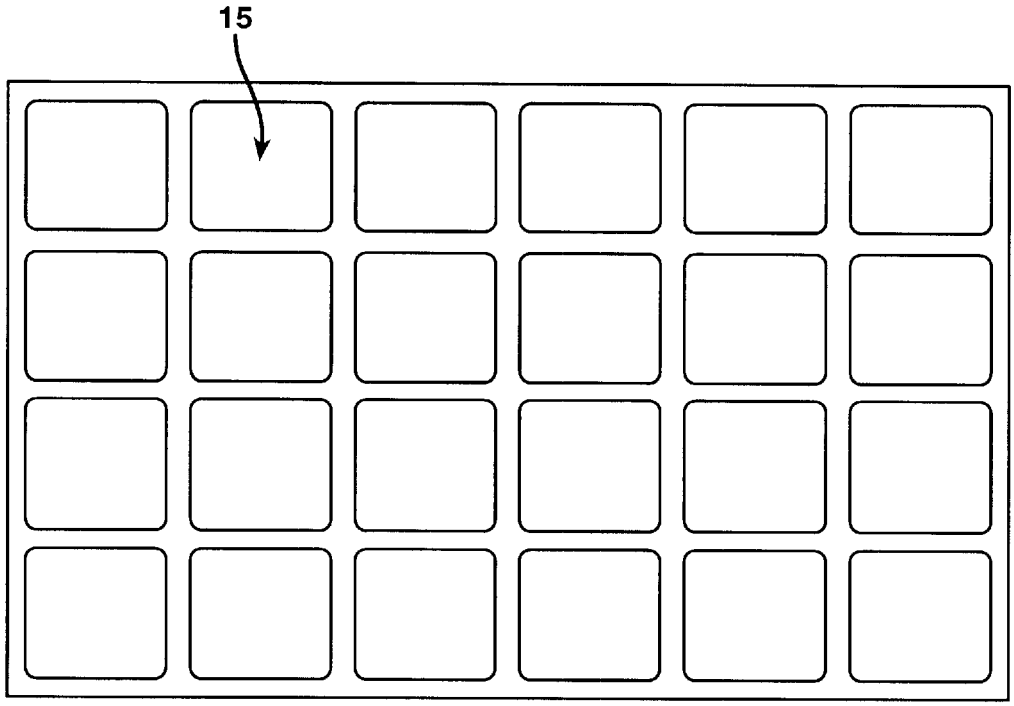
FIGS. 4A and 4B illustrate a cooling pad having a top sheet and a bottom sheet both being microperforated.
Figure 4B:
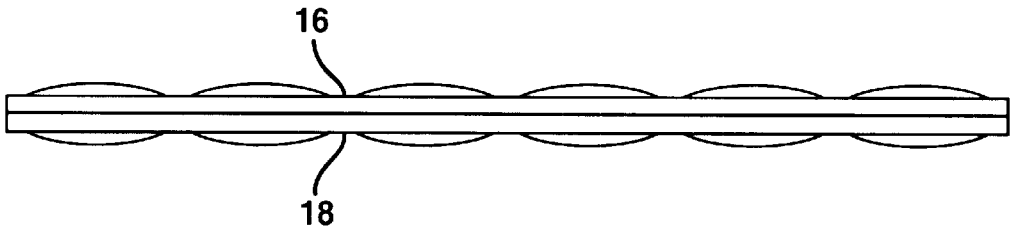
Figure 5A:
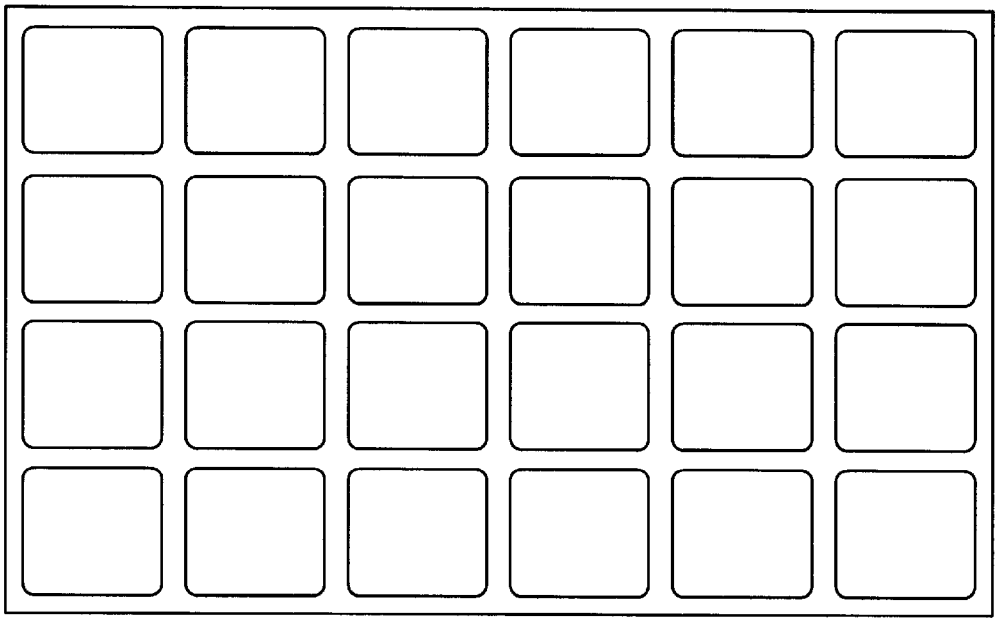
FIGS. 5A and 5B illustrate a cooling pad having a top sheet which is microperforated and a water impervious bottom sheet.
Figure 5B:
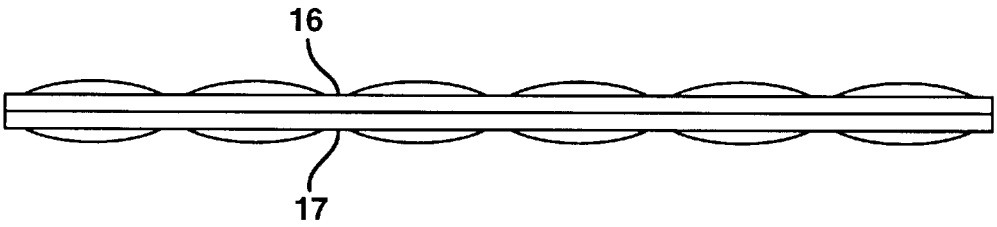
Figure 6A:
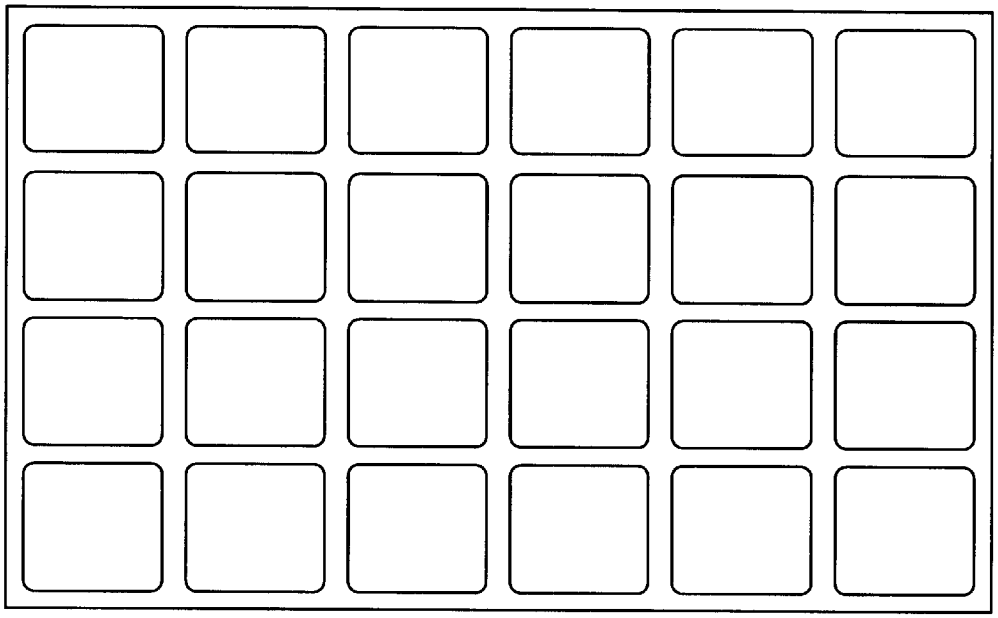
FIGS. 6A and 6B illustrate a cooling pad having a top sheet which is microperforated and a bottom sheet formed from a non-woven fabric.
Figure 6B:
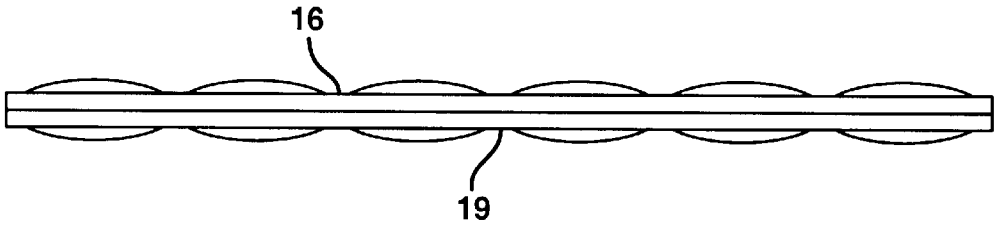

FIGS. 4–6 show thermal pads such as cooling pads. The pads again have an array of separate cells 15 in which the absorbent can be placed. In these embodiments, the top sheet 16 of the cooling pad is formed from a material identical to that of the absorbing pads of FIGS. 1–3. In FIG. 5, the bottom sheet 17 of the cooling pad is formed from a totally water impermeable plastic or laminated film such that water can only be absorbed through the microperforated top sheet. As we prefer that the polymer in the cell is fully hydrated, we do not find it useful to have any intermediate paper sheet such as found with the absorbent pad, as the paper sheet tends to reduce the bond strength and the cooling pad is under much more strain than the absorbing pad as much more water is absorbed by the polymer in the cooling pad before it is frozen. In FIG. 4, the bottom sheet 18 is identical to the top sheet and in FIG. 6, the bottom sheet 19 is a non-woven fabric.

Figure 7A:
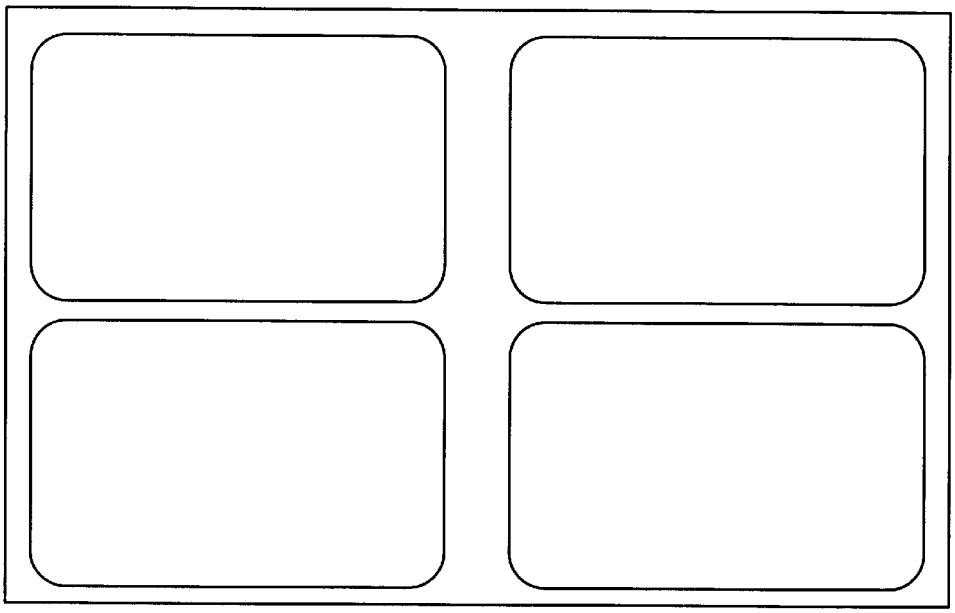
FIGS. 7A and 7B illustrate a fluid absorbing pad having top and bottom sheets which are microperforated and formed from three layers.
Figure 7B:
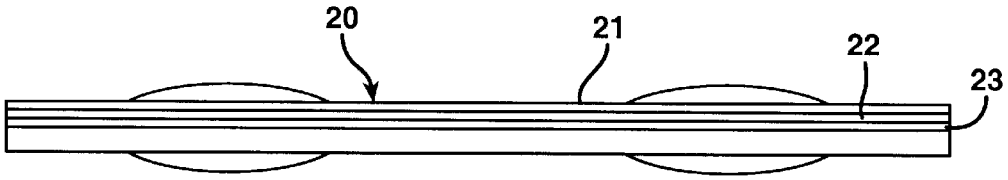
Figure 8A:
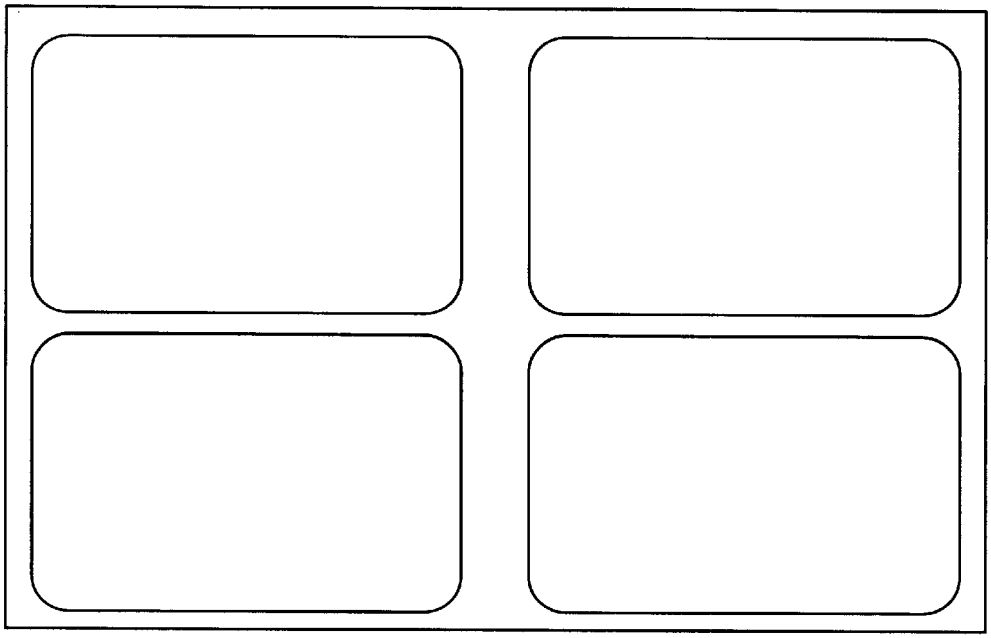
FIGS. 8A and 8B illustrate a fluid absorbing pad where the top sheet is microperforated and is formed from three layers and the bottom sheet is a non-woven fabric.
Figure 8B:
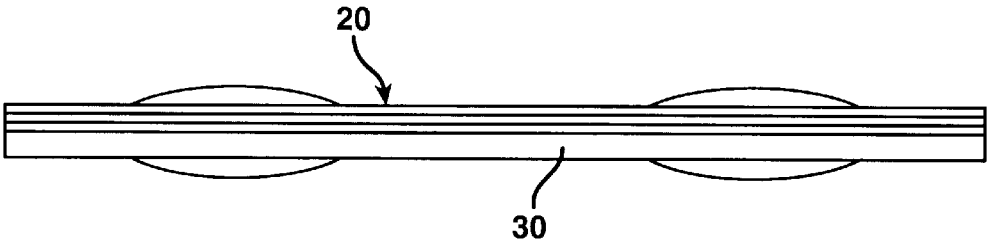
Figure 9A:
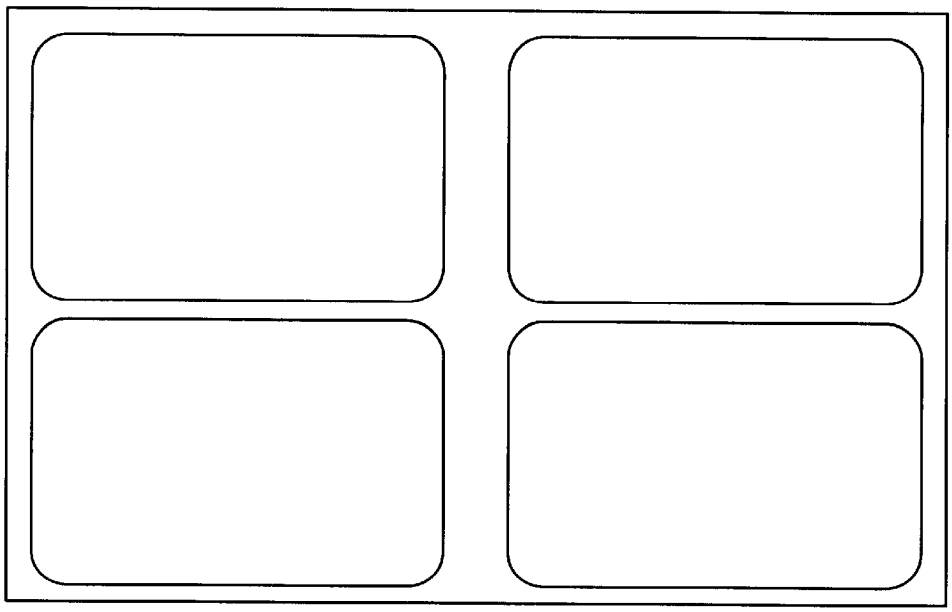
FIGS. 9A and 9B illustrate a fluid absorbing pad where the top sheet is microperforated and is formed from three layers and the bottom sheet is paper.
Figure 9B:
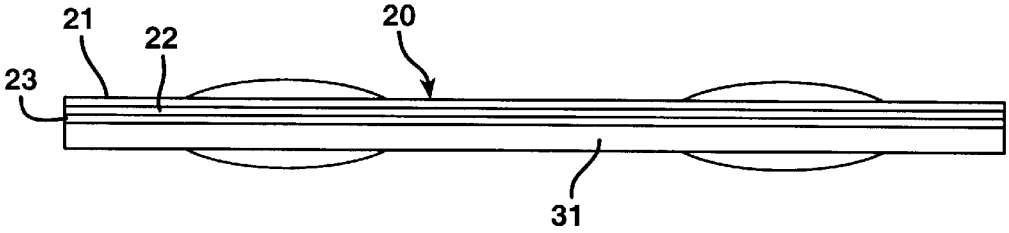

FIGS. 7–9 illustrate further embodiments of pads according to the invention. In these embodiments, the top sheet 20 of each pad is itself formed from a triple layer. The triple layer has an outermost sheet which is a microperforated 12 micron polyester film 21. Immediately behind the sheet is a paper sheet 22 which can have a weight of 38 g per square meter. Immediately behind paper sheet 22 is a second perforated polyethylene sheet 23 having a thickness of 25 microns. Thus, it can be seen that top sheet 20 can be seen as a single sheet formed from three layers being two microperforated layers between which is sandwiched a paper layer. In FIG. 7, the bottom layer 24 is also formed from an identical composite as the top layer such that the absorbing pad of FIG. 7 is formed from two sheets each having a triple layer structure.

The pad of FIG. 8 also has a triple layer top sheet 21–23, but in this pad, the bottom sheet is made from a non-woven fabric 30.

FIG. 9 illustrates a pad where the top sheet is again formed from the triple layer 21–23 and the bottom sheet is formed from a heavy weight paper 31.

Figure 10A:
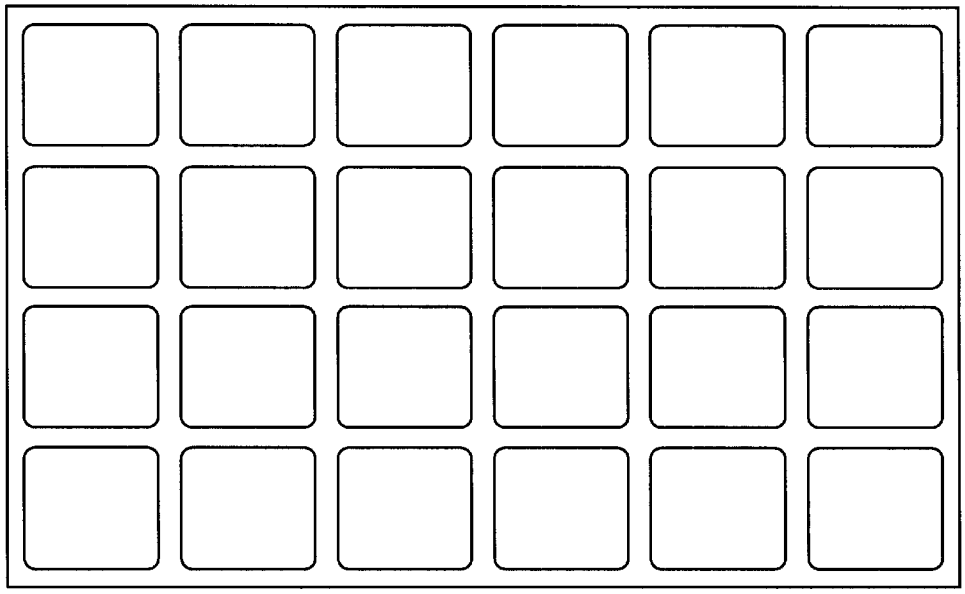
FIGS. 10A and 10B illustrate a cooling pad where the top sheet is microperforated and is formed from three layers and the bottom sheet is a non-woven fabric.
Figure 10B:
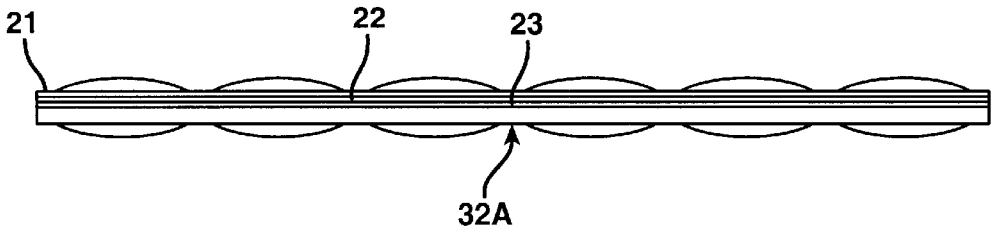
Figure 11A:
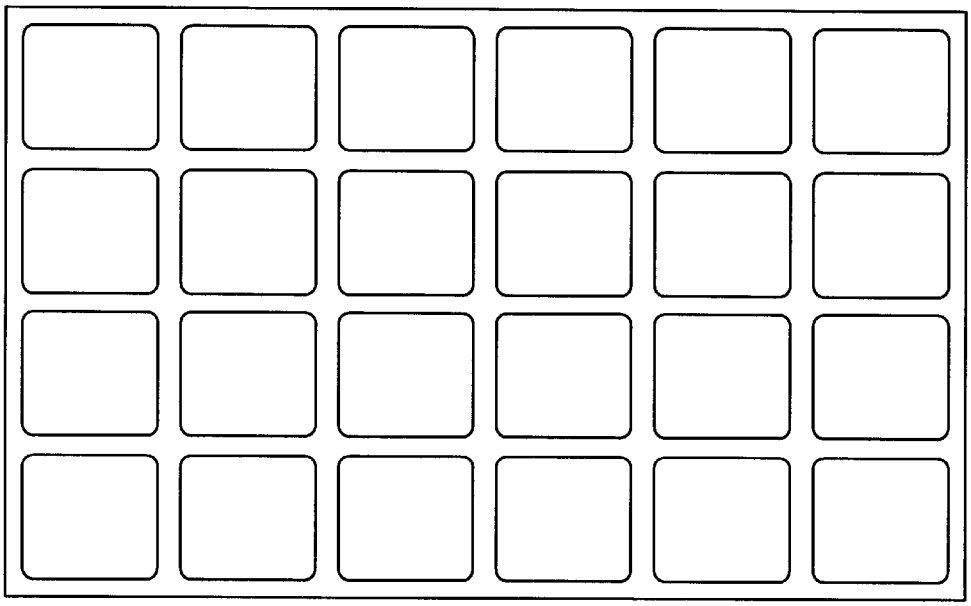
FIGS. 11A and 11B illustrate a cooling pad where the top sheet is microperforated and is formed from three layers and the bottom sheet is also formed from three layers.
Figure 11B:
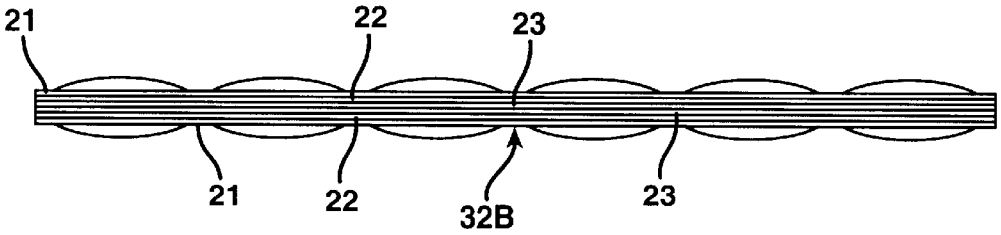
Figure 12A:
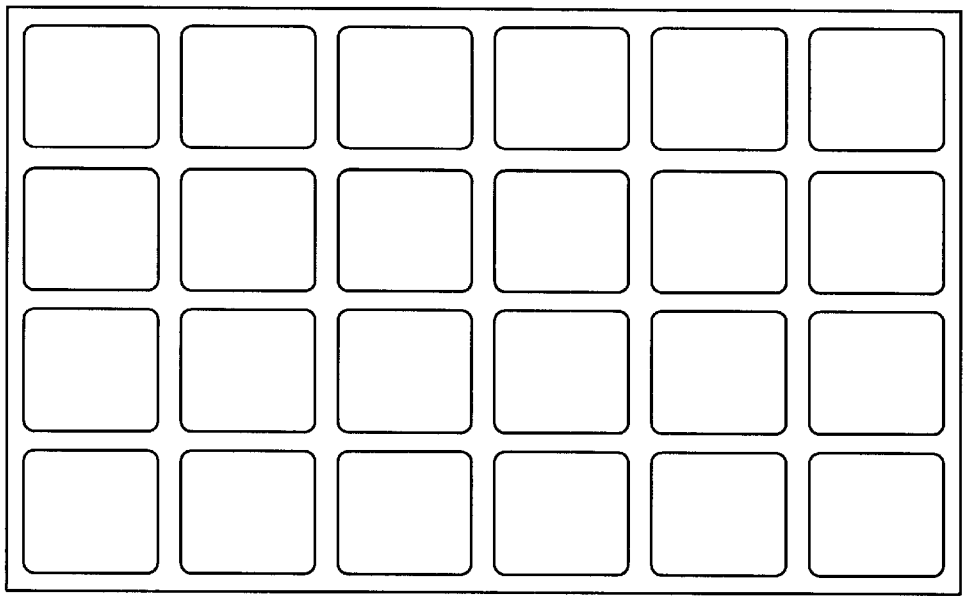
FIGS. 12A and 12B illustrate a cooling pad where the top sheet is microperforated and is formed from three layers and the bottom sheet is water impervious.
Figure 12B:
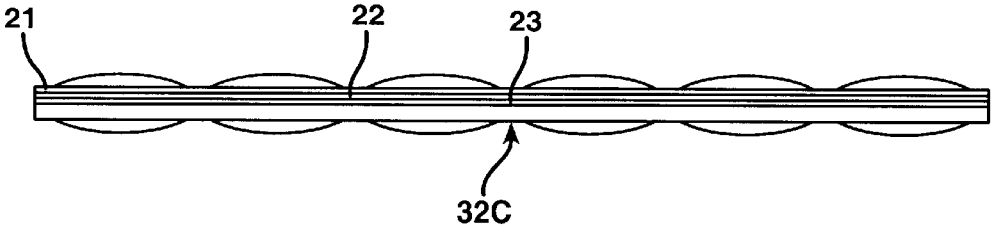

FIGS. 10–12 show further thermal pads which can be used as cooling pads or heating pads or can be seen as an ice replacement pad (as can the pads of FIGS. 4–6). In the pads illustrated in FIGS. 10–12, the top sheet is again formed from the triple layers 21–23 previously described. In FIG. 10, the bottom sheet 32A is formed from non-woven fabric. In FIG. 11, the bottom sheet 32B is formed from the triple layer structure identical to the top sheet while in FIG. 12, the bottom sheet is formed from a non-perforated plastic laminated film 32C.

The triple layered top sheet as illustrated in FIGS. 7–12 has a 12 micron microperforated polyester top sheet which gives the product excellent strength and provides desirable properties under high temperature and pressure when manufacturing the finished goods. This particular sheet can be reverse printed for product description and advertising purposes. The intermediate paper layer acts as an extremely good molecular sieve to negate any unhydrated polymer and hydrated gel migration through the film. We find that the paper can also act as a transporter of fluids through the two microperforated layers and this is done both in the Z axis and the X-Y axis. The intermediate paper layer can have a weight range of between 5 g–100 g per square meter as long as it provides adequate retention of the absorption powder both in the hydrated and hydrated form. The third layer of the triple layer structure can be a microperforated polyethylene film and this film can be a mixture of low density polyethylene and linear low density polyethylene with a view to being heat sealable to the bottom sheet to form the pad. Of course, and as described above, a number of different films can be used, for instance nylon, all types of polypropylenes, all types of polyethylenes, their mixtures, polyurethanes and polyvinyl resins.

In an embodiment, the triple layer sheet can be formed as follows. Firstly, the three layers are adhesively laminated together and cured. The unperforated cured sheet is run through a microfine perforator and perforated on one side only making sure that the perforation pins do not pass into the intermediate paper layer. The sheet is then turned over and passed through the microfine perforator, and again the perforating pins pass through the topmost layer only and do not pass through the intermediate paper layer. By having the intermediate paper layer intact and unperforated, it functions effectively as a molecular sieve and does not permit migration of polymer through the sheet.

It is noted that when biofluids of water come into contact with the outermost layer of this triple layer sheet, the fluid is drawn into the structure through the microfine perforations by the capillary section of the paper. The perorations on each side of the sheet need not line up and therefore liquid drawn through the three sheets need not adopt a linear path. This appears also to have some benefit in retention of the polymer in the cells.

Figure 13A:
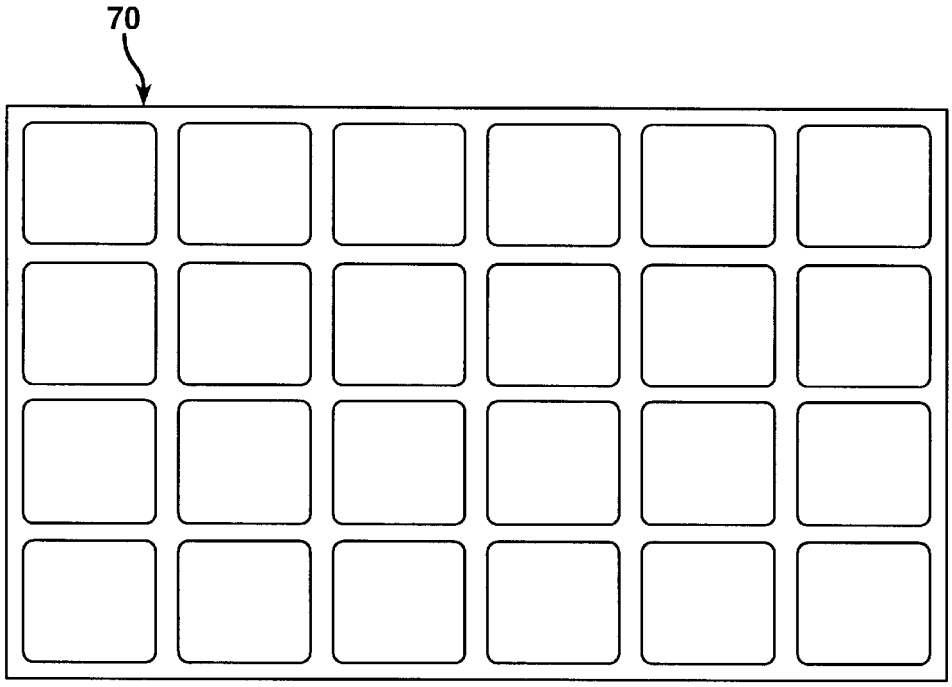
FIGS. 13A and 13B illustrate a cooling pad where the top sheet is microperforated and is formed from two layers and the bottom sheet is formed from one layer.
Figure 13B:
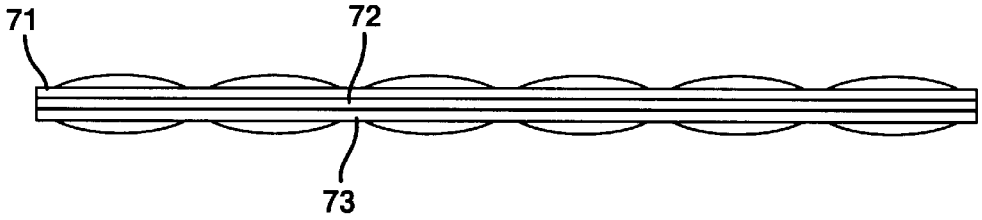

Referring to FIGS. 13A and 13B, there is illustrated a cooling pad 70 where the top sheet 71 is formed from a microperforated layer as described previously. Immediately behind the microperforated layer is a non-woven fabric 72. The non-woven fabric in the embodiment is an ELEVES™ fabric. The fabric is a white non-woven, 40 g per square meter, bi-component continuous filament fabric. The bottom sheet 73 is formed from a non-perforated plastic laminated film.

Figure 14A:
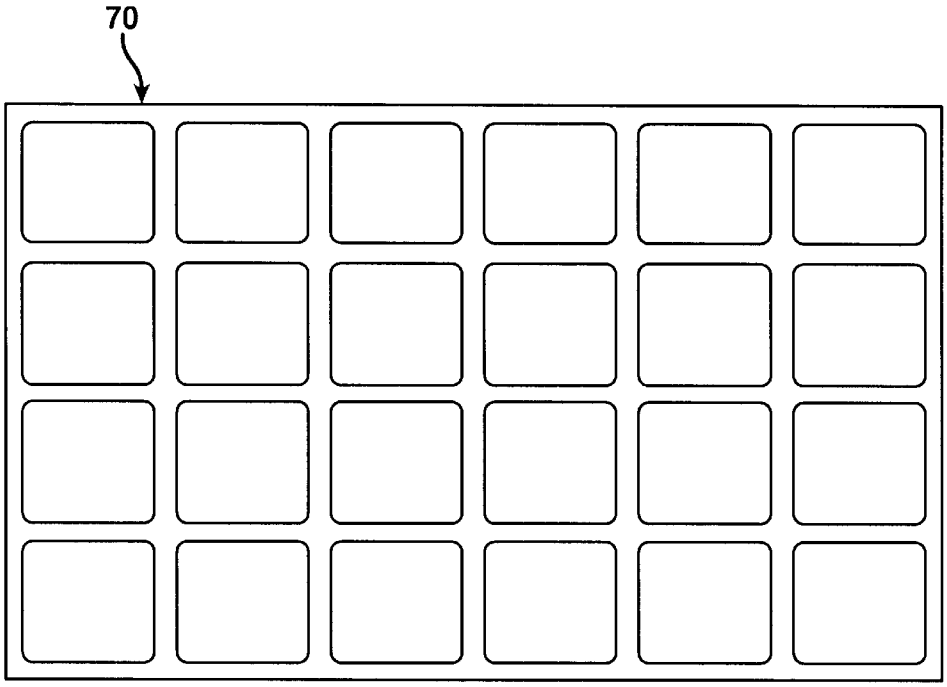
FIGS. 14A and 14B illustrate a cooling pad where the top sheet and the bottom sheet are both formed from two layers.
Figure 14B:
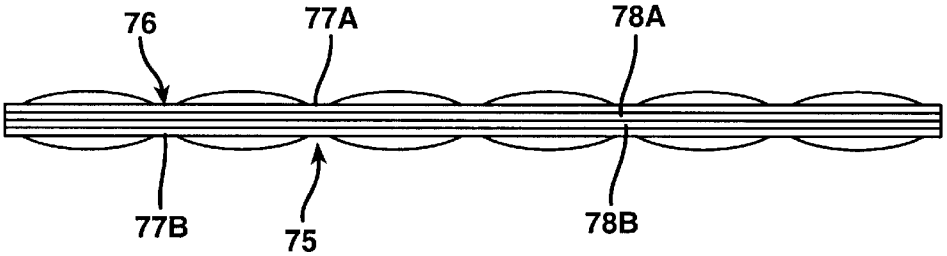

FIGS. 14A and 14B show a similar structure except that the bottom sheet 75 is identical to the top sheet 76, with both sheets including outermost microperforated laminated plastic films 77A, 77B immediately behind which is a non-woven fabric 78A, 78B, an example of which is ELEVES™ fabric.

The products illustrated in FIGS. 13A, 13B, 14A and 14B have a reinforcing sheet in the form of the non-woven fabric. The reinforcing sheet gives the microperforated sheet greater support and provides strength to the overall product. As the microperforations do weaken the laminate film, it is possible that when the product is hydrated fully, and the sheet is bent or twisted, the microperforated laminate can crack and tear therefore allowing the perforations to become larger in size and possibly allowing the superabsorbent polymer to pass through the pad. The pressure can be exacerbated by freezing the pad and wrapping sheet containing the frozen pads around articles that need to be kept cool. The already weakened film when cold may approach its cold flex temperature which causes the film to resist flexing and forcibly wrapping the film around articles can create cracks and tears. The ELEVES™ has a non-woven design which can substantially contain the polymer should cracking or tearing of the microperforated layer still occur.

Figure 15A:
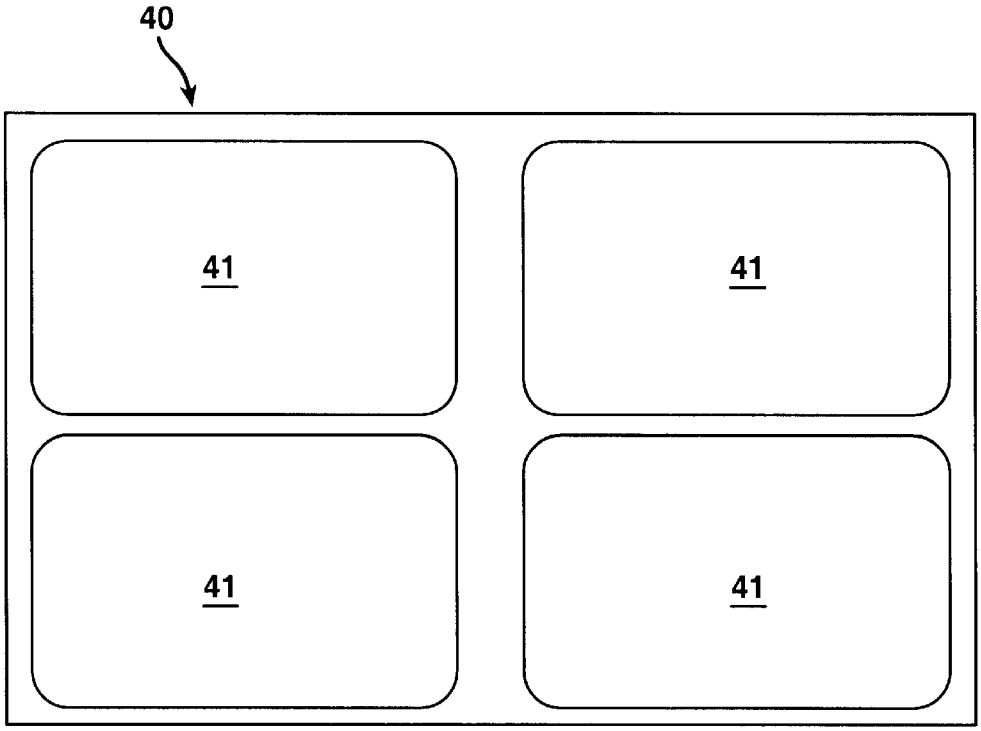
FIGS. 15A and 15B illustrate a fluid absorbing pad where the top sheet and the bottom sheet are formed from two layers being a microperforated layer and an intermediate paper layer.
Figure 15B:
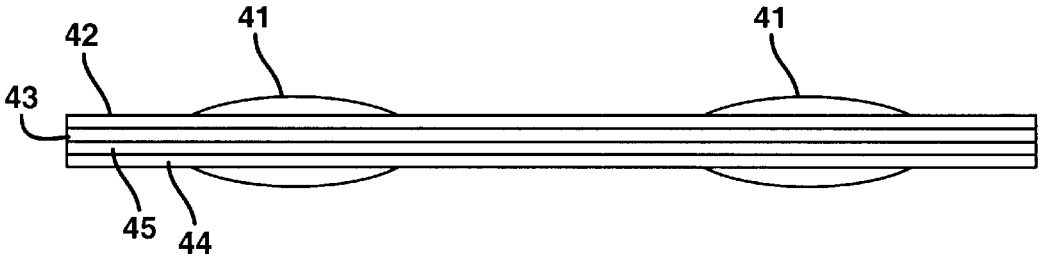

FIGS. 15A and 15B illustrate a fluid absorbent pad 40 having four cells 41 (the number of cells being optional). The pad is formed from a top sheet and a bottom sheet. The top sheet is formed from two layers being a microperforated plastic laminate sheet 42 immediately behind which is an intermediate paper sheet 43. The bottom sheet is formed from the same two layers being an outer microperforated plastic laminate sheet 44 and an intermediate paper sheet 45.

Figure 16A:
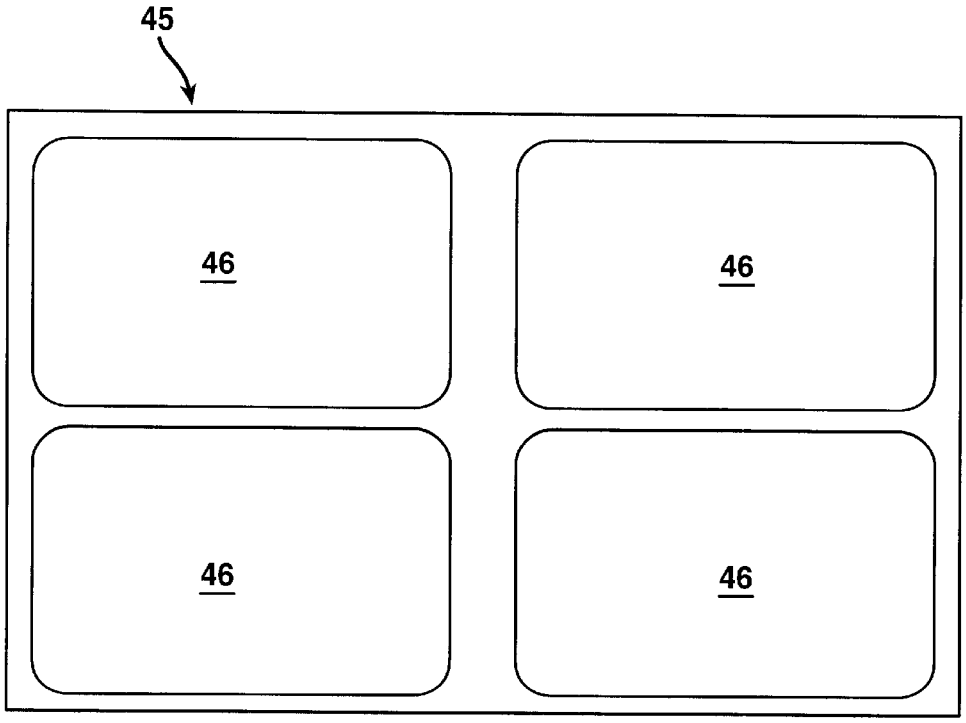
FIGS. 16A and 16B illustrate a fluid absorbing pad where the top sheet is formed from two layers being microperforated layer and a paper layer, and the bottom sheet is a non woven fabric.
Figure 16B:
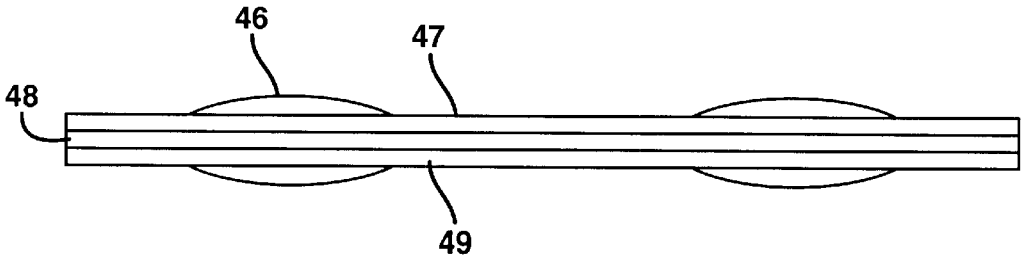

FIGS. 16A and 16B show a pad 45 having four cells 46. The pad is a fluid absorbing pad having a top sheet formed from two layers being an outer microperforated plastic laminate sheet 47 and an intermediate paper sheet 48. In this pad, the bottom sheet 49 is formed from one layer of non-woven fabric.

Figure 17A:
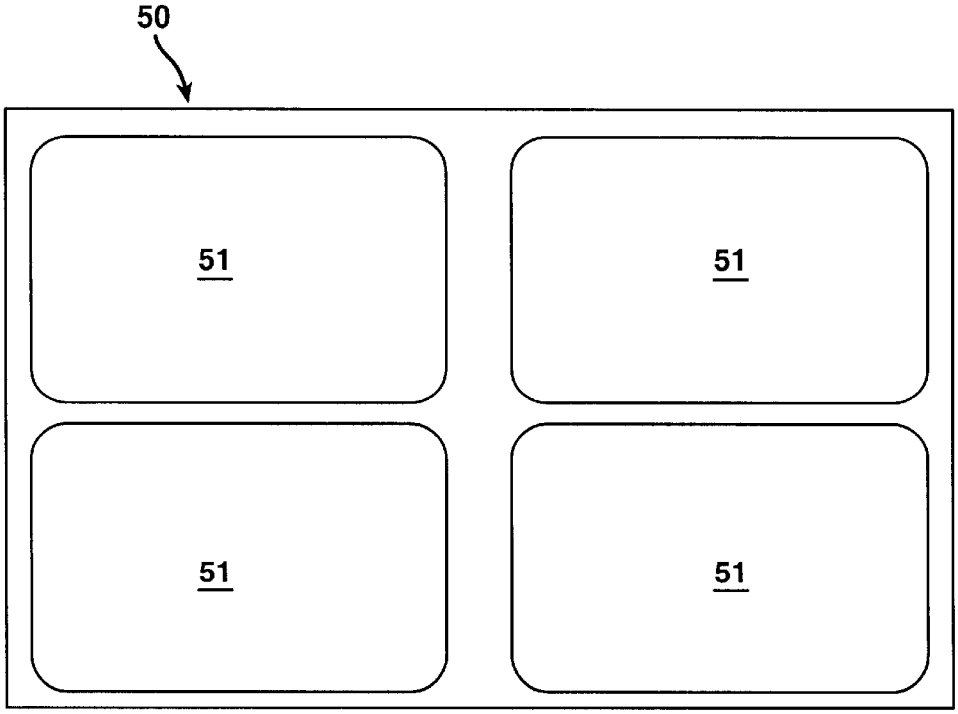
FIGS. 17A and 17B illustrate a fluid absorbing pad where the top sheet is formed two layers being a microperforated layer and a paper layer, and the bottom sheet is a paper layer.
Figure 17B:
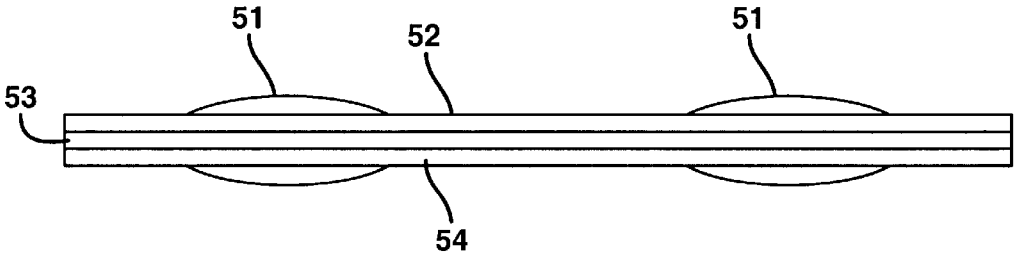

FIGS. 17A and 17B show a fluid absorbing pad 50 having four cells 51. The top sheet is formed from two layers being an outermost microperforated plastic laminate sheet 52 and an intermediate paper sheet 53 while the bottom sheet 54 is formed from one layer of paper.

Figure 18:
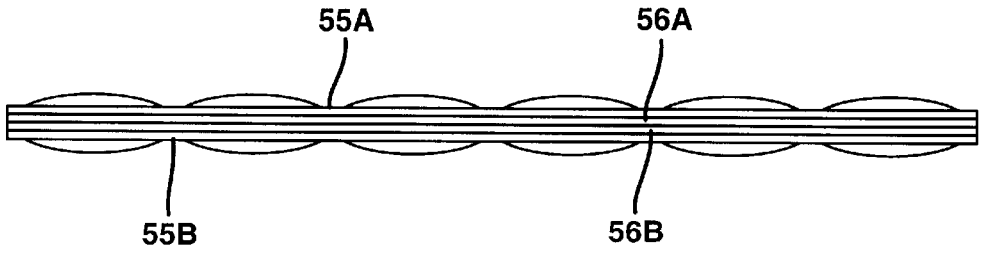
FIG. 18 illustrates a cooling pad where the top sheet and the bottom sheet are both formed from two layers being a microperforated layer and a non woven fabric layer.

FIG. 18 is a side view of a cooling pad where the top and bottom sheets are both formed from two layers being an outermost microperforated plastic laminate sheet 55A, 55B with a intermediate non-woven fabric sheet 56A, 56B.

Figure 19:
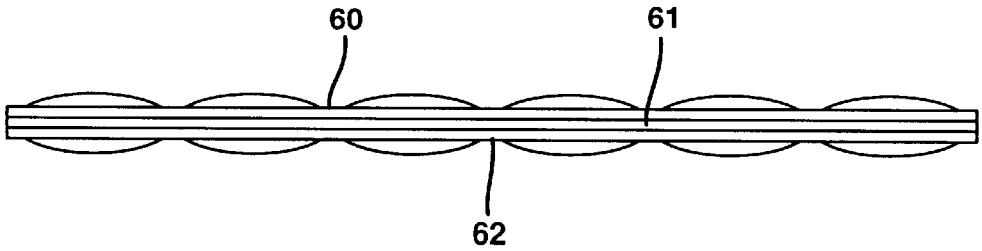
FIG. 19 illustrates a cooling pad where the top sheet is formed from two layers being a microperforated layer and a non woven fabric layer, and the bottom sheet is a non woven fabric.

FIG. 19 illustrates a further cooling pad where the top sheet is formed from two layers having an outermost microperforated plastic laminate sheet 60 and an intermediate non-woven fabric sheet 61 while the bottom sheet is formed from one layer of non-woven fabric 62.

Figure 20A:
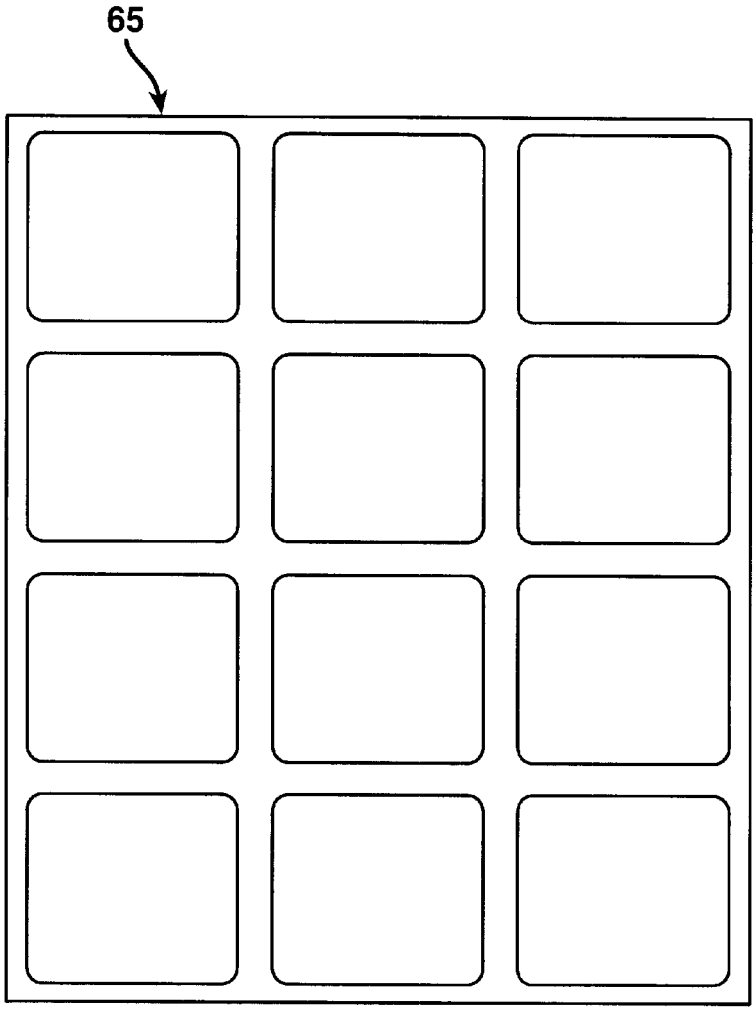
FIG. 20 illustrates a fluid absorbing pad where the top sheet is formed from two layers being a microperforated plastic co-extruded layer and a non woven fabric layer, and the bottom sheet is formed from two layers of non woven fabric.
Figure 20B:
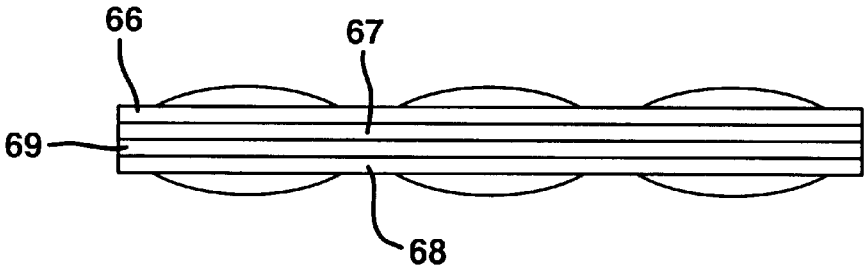

FIGS. 20A and 20B illustrate a fluid absorbing pad 65 having a number of separate cells therein. The pad has a top sheet formed from two layer being an outermost microperforated plastic co-extruded sheet 66 behind which is a non-woven fabric sheet 67. The bottom sheet is formed from two layers 68, 69 each being a non-woven fabric.

The fluid absorbing pad comes in three main sizes being a twelve cell pad either 400 mm×141 mm, or 200 mm×280 mm, and a nine cell pad which is 200 mm×211 mm. Other sizes are available.

In FIG. 20, the absorbing pad is a four layer pad. The plastic is of a different type being a multi-layered co-extruded film. The three different layers are made of either a high density polyethylene or low density polyethylene/linear low density polyethylene blends to adjust melting temperatures. The top layer of the pad is the co-extruded plastic with the second layers being a non-woven fabric. The bottom sheet is made of two non-woven fabric layers.

It should be appreciated that various other changes and modifications can be made to the invention. That is, it should be appreciated that the pad size and shape can vary, the type of top and bottom sheet can vary as long as at least one sheet has the microperforations, the type of polymer and the amount of polymer can also vary to suit. The pad can be used as a biofluid absorbing pad, as a cooling pad, as a heating pad (it being appreciated that the cooling pad, once swollen, can be heated to function as a "hot pack"). The pads can be used for humidity control in packaging and may find use in the fresh flower industry.

What is claimed is:

1. An absorbent pad comprising a top sheet and a bottom sheet, the sheets being joined to form at least one cell, an absorbent located within the cell, characterized in that at least one of the sheets is formed as a lamination of two microperforated sheets each formed from a liquid impermeable sheet containing microperforations, and an intermediate liquid permeable layer sandwiched between the microperforated sheets, the microperforations allowing fluid to pass therethrough and into the cell.

2. The pad of claim 1, wherein the top sheet is formed as the lamination of the two microperforated sheets and the intermediate liquid permeable layer.

3. The pad of claim 1, wherein the microperforations are spread over the microperforated sheet in a substantially homogenous fashion.

4. The pad of claim 1, wherein the microperforations are between 10 and 200 microns.

5. The pad of claim 4, comprising between 10 to 500 microperforations per square inch.

6. The pad of claim 1, having a width of between 200–500 mm, between 2–10 cells extending across the pad, each cell being between 40 mm to 100 mm across.

7. The pad of claim 1, wherein the microperforated sheets are formed from plastic.

8. The pad of claim 1, comprising a fluid absorbing pad having a top sheet and a bottom sheet both being microperforated.

9. The pad of claim 1, comprising a fluid absorbing pad having a top microperforated sheet and a bottom non-woven fabric sheet.

10. The pad of claim 1, comprising a fluid absorbing pad having a top microperforated sheet and a bottom paper sheet.

11. The pad of claim 1, comprising a cooling pad having a top sheet and a bottom sheet both being microperforated.

12. The pad of claim 1, comprising a cooling pad having a top sheet which is microperforated and a water impervious bottom sheet.

13. The pad of claim 1, comprising a cooling pad having a top sheet which is microperforated and a bottom sheet formed from a non-woven fabric.

14. The pad of claim 1, wherein the bottom sheet comprises the lamination of two microperforated sheets and the intermediate liquid permeable layer.

15. The pad of claim 1, wherein the bottom sheet is a non-woven fabric.

16. The pad of claim 1, wherein the bottom sheet is paper.

17. The pad of claim 1, 14, 15, or 16 comprising a cooling pad.

18. The pad of claim 1, comprising a cooling pad and where the bottom sheet is water impervious.

19. An absorbent pad which has a top sheeet and a bottom sheet, the sheets being joined to form at least one cell, an absorbent located within the cell, characterized in that each of the sheets are formed from two layers, the two layers being an outermost microperforated sheet and an inner paper sheet.

20. The pad of claim 1, comprising a cooling pad where the top sheet is formed from two layers being an outer microperforated layer and an inner non-woven fabric layer.

21. The pad of claim 1, wherein the bottom sheet is formed from two layers of non-woven fabric.

* * * * *